US012655748B2

(12) United States Patent
Park et al.

(10) Patent No.: US 12,655,748 B2
(45) Date of Patent: Jun. 16, 2026

(54) SYSTEM AND METHOD FOR UNCERTAINTY CALCULATION IN UNCONVENTIONAL HYDROCARBON RESERVOIRS

(71) Applicant: Chevron U.S.A. Inc., San Ramon, CA (US)

(72) Inventors: Han-Young Park, Katy, TX (US); Baosheng Liang, Houston, TX (US); Yunhui Tan, Katy, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 494 days.

(21) Appl. No.: 18/159,626

(22) Filed: Jan. 25, 2023

(65) Prior Publication Data

US 2023/0235660 A1 Jul. 27, 2023

Related U.S. Application Data

(60) Provisional application No. 63/303,262, filed on Jan. 26, 2022.

(51) Int. Cl.
*E21B 47/022* (2012.01)

(52) U.S. Cl.
CPC ..... *E21B 47/022* (2013.01); *E21B 2200/20* (2020.05); *E21B 2200/22* (2020.05)

(58) Field of Classification Search
CPC ..... E21B 47/022; E21B 47/02; E21B 47/00; E21B 2200/20; E21B 2200/22; E21B 2200/00; E21B 41/00
See application file for complete search history.

(56) References Cited

U.S. PATENT DOCUMENTS

2009/0164186 A1* 6/2009 Haase ..... G01V 99/00 703/2
2012/0215512 A1* 8/2012 Sarma ..... E21B 43/00 703/10
2013/0185033 A1* 7/2013 Tompkins ..... G06F 30/20 703/2
2016/0042272 A1 2/2016 Mohaghegh
2016/0138371 A1* 5/2016 Loaiza ..... E21B 41/00 703/2

OTHER PUBLICATIONS

Madasu, Srinath, et al.; "Compressing Time-Dependent Reservoir Simulations Using Graph-Convolutional Neural Network G-CNN"; SPE-197444-MS, (2019), pp. 1-14.
International Search Report, issued on May 15, 2023, during the prosecution of International Application No. PCT/IB2023/050617.
Written Opinion of the International Searching Authority, issued on May 15, 2023, during the prosecution of International Application No. PCT/IB2023/050617.

* cited by examiner

*Primary Examiner* — Mohamed Charioui
(74) *Attorney, Agent, or Firm* — Marie L. Clapp

(57) ABSTRACT

A system and method for uncertainty estimation of reservoir parameters in unconventional reservoirs using a physics-guided convolutional neural network to generate a plurality of reservoir models, a data analysis step, and an uncertainty step is disclosed. The method is a computationally efficient method to estimate uncertainties in models of unconventional reservoirs.

6 Claims, 15 Drawing Sheets

Selected Probabilistic P10, P50, P90 Models (based on OPC simulation results)

| | Run Label | Iteration# | PRisk | YRed | StressPP | StressAMS | FH | DFM | Sep | OPC:FIELD:#:EOS |
|---|---|---|---|---|---|---|---|---|---|---|
| 1 | WellB_Run_1_80 | 1 | L | H | H | L | H | L | H | [illegible] |
| 2 | WellB_Run_1_4 | 2 | M | M | L | M | M | M | M | [illegible] |
| 3 | WellB_Run_1_39 | 3 | M | M | H | M | M | M | L | [illegible] |

OPC Histogram Defining Probabilistic P10, P50, P90

Estimated SRV Volume Uncertainties by Model

Geophysical and Geomechanical Property Sensitivity Estimated by present invention vs. conventional method

Present Invention

Prior Art

- Results are consistent between methods

Geophysical and Geomechanical Property Significance Estimated by present invention vs. conventional method

Present Invention

Prior Art

- Results are consistent between methods

Probabilistic Models Selected by new method and conventional method

High Correlation Between Simulation Estimated Recovery and CNN Estimated SRV Volume

SYSTEM AND METHOD FOR UNCERTAINTY CALCULATION IN UNCONVENTIONAL HYDROCARBON RESERVOIRS

CROSS-REFERENCE TO RELATED APPLICATIONS

This application claims the benefit of U.S. Provisional Application 63/303,262 filed Jan. 26, 2022.

STATEMENT REGARDING FEDERALLY SPONSORED RESEARCH OR DEVELOPMENT

Not applicable.

TECHNICAL FIELD

The disclosed embodiments relate generally to techniques for probabilistic modeling of unconventional hydrocarbon reservoirs. The embodiments allow uncertainty calculations for the models.

BACKGROUND

Unlike conventional reservoirs, the probabilistic P10-P50-P90 model selection process for unconventional reservoirs is extremely time-consuming and therefore can only consider a limited number of reservoir models, thus preventing engineers from capturing a full range of uncertainties. Unconventional reservoirs may include shale reservoirs and other tight reservoirs in which rocks have pores so small or poorly connected that the oil and natural gas cannot flow through them easily. In such unconventional reservoirs, hydraulic fractures may be required to allow the hydrocarbons to flow. Reservoir models are three-dimensional (3D) digital representations of subsurface formations and their associated features and are constructed based on geophysical and geological observations. The reservoir models are then integrated with dynamic data (e.g. hydrocarbon fluid, well and field operational data) to build reservoir simulation models that are eventually used for forecasting production and reservoir management. Unlike conventional reservoir simulation, unconventional reservoir simulation model requires additional information of hydraulic fractures that is obtained by separate hydraulic fracturing simulation where geomechanical properties (e.g. stress, Young's module, Poisson ratio etc.) are key drivers to fracture geometry and results. The ranges of the characteristics of the reservoir are reflected in ranges of different hydraulic fracture models. The selection of representative models with probabilistic P10, P50, P90 models for business decisions are mostly based on hydrocarbon production obtained from the reservoir simulation. Since more types of subsurface properties are required for unconventional reservoir modeling and additional fracture simulation prior to reservoir simulation is needed, there is a high computational cost to create many models. Uncertainty analysis requires many models and selection of the representative models to be used in uncertainty quantification, which is unfortunate since managing the risk inherent in producing hydrocarbons from unconventional reservoirs requires a good understanding of the uncertainties in the reservoir models.

There exists a need for a computationally feasible way to generate many models of an unconventional reservoir to enable an understanding of the uncertainties present in the subsurface volume of interest.

SUMMARY

In accordance with some embodiments, a method of an efficient workflow for uncertainty estimation of reservoir parameters in unconventional reservoirs is disclosed. The method may include obtaining a trained physics-guided neural network; receiving models of reservoir properties representing at least three levels of probabilities and a well trajectory through the models; slicing the models into a plurality of 2-D slices orthogonal to a direction of the well trajectory; providing the 2-D slices as input to the trained physics-guided neural network to generate predicted permeability models; calculating stimulated reservoir volumes based on the predicted permeability models; using the stimulated reservoir volumes to calculate uncertainties and determine a probability distribution of the stimulated reservoir volumes; selecting a representative stimulated reservoir volume from the stimulated reservoir volumes based on the probability distribution of the stimulated reservoir volumes; generating a graphical representation of one or more of the predicted permeability models, the stimulated reservoir volumes, the representative reservoir volume, the uncertainties, and the probability distribution of the stimulated reservoir volumes; and displaying the graphical representation on a graphical display.

In another aspect of the present invention, to address the aforementioned problems, some embodiments provide a non-transitory computer readable storage medium storing one or more programs. The one or more programs comprise instructions, which when executed by a computer system with one or more processors and memory, cause the computer system to perform any of the methods provided herein.

In yet another aspect of the present invention, to address the aforementioned problems, some embodiments provide a computer system. The computer system includes one or more processors, memory, and one or more programs. The one or more programs are stored in memory and configured to be executed by the one or more processors. The one or more programs include an operating system and instructions that when executed by the one or more processors cause the computer system to perform any of the methods provided herein.

BRIEF DESCRIPTION OF THE DRAWINGS

Like reference numerals refer to corresponding parts throughout the drawings.

DETAILED DESCRIPTION OF EMBODIMENTS

Described below are methods, systems, and computer readable storage media that provide a manner of uncertainty estimation of reservoir parameters in unconventional reservoirs.

Reference will now be made in detail to various embodiments, examples of which are illustrated in the accompanying drawings. In the following detailed description, numerous specific details are set forth in order to provide a thorough understanding of the present disclosure and the embodiments described herein. However, embodiments described herein may be practiced without these specific details. In other instances, well-known methods, procedures, components, and mechanical apparatus have not been described in detail so as not to unnecessarily obscure aspects of the embodiments.

The methods and systems of the present disclosure may, in part, use one or more models that are machine-learning algorithms. These models may be supervised or unsupervised. Supervised learning algorithms are trained using labeled data (i.e., training data) which consist of input and output pairs. By way of example and not limitation, supervised learning algorithms may include classification and/or regression algorithms such as neural networks, generative adversarial networks, linear regression, etc. Unsupervised learning algorithms are trained using unlabeled data, meaning that training data pairs are not needed. By way of example and not limitation, unsupervised learning algorithms may include clustering and/or association algorithms such as k-means clustering, principal component analysis, singular value decomposition, etc. Although the present disclosure may name specific models, those of skill in the art will appreciate that any model that may accomplish the goal may be used.

Figure 1:
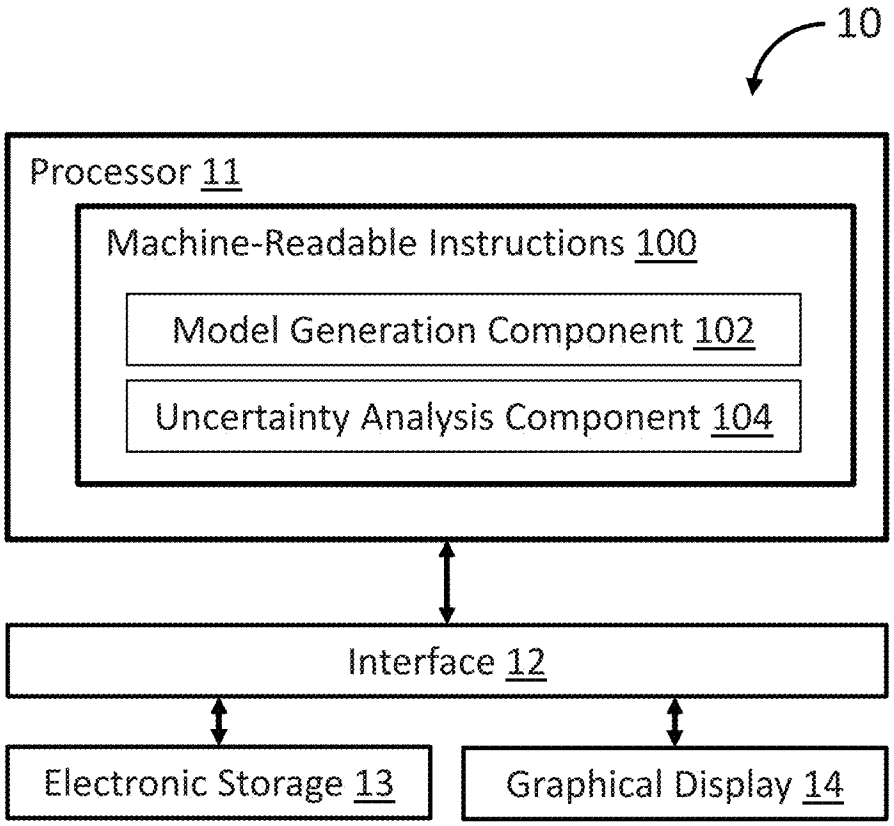
FIG. 1 illustrates an example system for uncertainty estimation of reservoir parameters in unconventional reservoirs.

The methods and systems of the present disclosure may be implemented by a system and/or in a system, such as a system 10 shown in FIG. 1. The system 10 may include one or more of a processor 11, an interface 12 (e.g., bus, wireless interface), an electronic storage 13, a graphical display 14, and/or other components. Processor 11 executes machine-readable instructions to execute an efficient workflow for uncertainty estimation of reservoir parameters in unconventional reservoirs.

A new approach is proposed to select probabilistic models using a convolutional neural network (CNN)-predicted HCIP (Hydrocarbon In Place) inside SRV (Stimulated Rock Volume). The HCIP-SRV has been proven as a key indicator to forecast production recovery from unconventional reservoir applications, because of its high correlations to oil production. Ranges of SRVs and its uncertainties computed by this CNN workflow are transferred to an uncertainty analysis program to run data analysis and select probabilistic models to represent subsurface uncertainties. All processes from data preparation to SRV calculation are automated and then integrated with the uncertainty analysis program. Such streamlined workflow adds more computational efficiency, enabling users to run all possible scenarios or full factorial cases, capture full range of outcomes, and identify the risks associated with subsurface uncertainties.

The electronic storage 13 may be configured to include electronic storage medium that electronically stores information. The electronic storage 13 may store software algorithms, information determined by the processor 11, information received remotely, and/or other information that enables the system 10 to function properly. For example, the electronic storage 13 may store information relating to reservoir properties, and/or other information. The electronic storage media of the electronic storage 13 may be provided integrally (i.e., substantially non-removable) with one or more components of the system 10 and/or as removable storage that is connectable to one or more components of the system 10 via, for example, a port (e.g., a USB port, a Firewire port, etc.) or a drive (e.g., a disk drive, etc.). The electronic storage 13 may include one or more of optically readable storage media (e.g., optical disks, etc.), magnetically readable storage media (e.g., magnetic tape, magnetic hard drive, floppy drive, etc.), electrical charge-based storage media (e.g., EPROM, EEPROM, RAM, etc.), solid-state storage media (e.g., flash drive, etc.), and/or other electronically readable storage media. The electronic storage 13 may be a separate component within the system 10, or the electronic storage 13 may be provided integrally with one or more other components of the system 10 (e.g., the processor 11). Although the electronic storage 13 is shown in FIG. 1 as a single entity, this is for illustrative purposes only. In some implementations, the electronic storage 13 may comprise a plurality of storage units. These storage units may be physically located within the same device, or the electronic storage 13 may represent storage functionality of a plurality of devices operating in coordination.

The graphical display 14 may refer to an electronic device that provides visual presentation of information. The graphical display 14 may include a color display and/or a non-color display. The graphical display 14 may be configured to visually present information. The graphical display 14 may present information using/within one or more graphical user interfaces. For example, the graphical display 14 may present information relating to the reservoir models, computed uncertainties, and/or other information.

The processor 11 may be configured to provide information processing capabilities in the system 10. As such, the processor 11 may comprise one or more of a digital processor, an analog processor, a digital circuit designed to process information, a central processing unit, a graphics processing unit, a microcontroller, an analog circuit designed to process information, a state machine, and/or other mechanisms for electronically processing information. The processor 11 may be configured to execute one or more machine-readable instructions 100 to facilitate uncertainty estimation of reservoir parameters in unconventional reservoirs. The machine-readable instructions 100 may include one or more computer program components. The machine-readable instructions 100 may include a model generation component 102, an uncertainty analysis component 104, and/or other computer program components.

It should be appreciated that although computer program components are illustrated in FIG. 1 as being co-located within a single processing unit, one or more of computer program components may be located remotely from the other computer program components. While computer program components are described as performing or being configured to perform operations, computer program components may comprise instructions which may program processor 11 and/or system 10 to perform the operation.

While computer program components are described herein as being implemented via processor 11 through machine-readable instructions 100, this is merely for ease of reference and is not meant to be limiting. In some implementations, one or more functions of computer program components described herein may be implemented via hardware (e.g., dedicated chip, field-programmable gate array) rather than software. One or more functions of computer program components described herein may be software-implemented, hardware-implemented, or software and hardware-implemented.

Referring again to machine-readable instructions 100, the model generation component 102 may be configured to generate a plurality of reservoir models. The model generation component 102 uses a physics-guided CNN. The CNN has been previously trained. In an embodiment, the training data was prepared through an integrated physical modeling workflow with earth modeling, hydraulic fracturing, performance prediction and uncertainty assessment and further validated through field production and surveillance in different areas and formations. The CNN architecture for deep learning is customized to deal with different scales in fractured- and non-fractured zones. It is not limited to a 1D or 2D dense network but can use different 2D or 3D convolutional neural networks, for example, UNet or Autoencoder models with residual like blocks or inception like blocks. The CNN may execute data ingestion by creating a super image set with multiple channels where each channel contains the specific 2D or 3D reservoir and rock properties and loading in batches for training and prediction. The method discretizes input and output properties and also considers transformations to change variables from linear to logarithm or exponential on the basis of physics. Finally, the method may add an extra loss function term for structural constraints to distinguish fractured and non-fractured zones where non-fractured zones retain as same as the original background and fracture zones are satisfied with local smoothing and considered by physical pattern continuities.

In an embodiment for training the CNN, a deep deconvolution neural network that performs pixel-wise image regression is used to predict subsurface reservoir image update using multiple image feature regression. The deconvolution net may be, by way of example and not limitation, composed of 13 hidden layers using convolution, max pooling, upsampling, batch normalization and deconvolution units. The first half part is similar to a VGG model and has a very flexible architecture that can be altered and trained for any dimension size and resolution of multiple different feature images. The second part up-samples and increase the low-resolution by max pooling back to original resolution. The proposed model may be trained, for example, using 1000 more cases from different hydraulic fracturing steps. In an embodiment, it may use distributed computation on a GPU cluster for higher performance.

In an embodiment, the method uses a physical-informed machine learning framework to combine different input image information like matrix permeability, porosity, water saturation, Young's modulus, minimum horizontal stress, reservoir pressure and clay content as the different image channels in the same neural network. To achieve output resolution same with the input, a deep deconvolution neural network that performs pixel-wise image regression is developed to predict subsurface reservoir image update. The deconvolution net is composed of more than 10 hidden layers, using convolution, max pooling, up-sampling, batch normalization and deconvolution units. It has a very flexible architecture that can be altered and trained for any dimension size and resolution of multiple different feature images.

The uncertainty analysis component 104 may be configured to determine and select P10, P50, and P90 models. Uncertainty analysis component 104 performs a data analysis step and an uncertainty analysis step.

The description of the functionality provided by the different computer program components described herein is for illustrative purposes, and is not intended to be limiting, as any of computer program components may provide more or less functionality than is described. For example, one or more of computer program components may be eliminated, and some or all of its functionality may be provided by other computer program components. As another example, processor 11 may be configured to execute one or more additional computer program components that may perform some or all of the functionality attributed to one or more of computer program components described herein.

Figure 2:
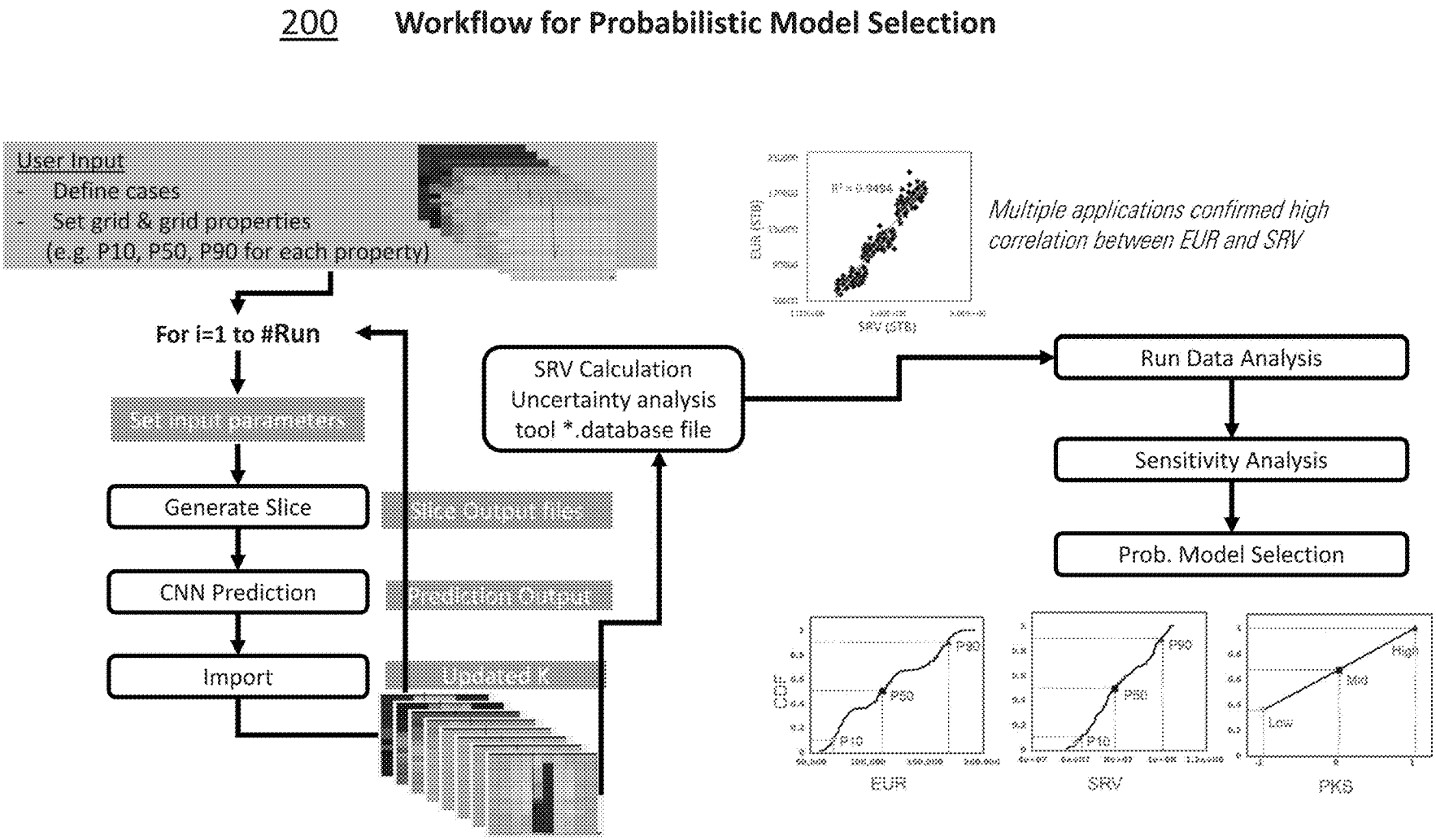
FIG. 2 illustrates a workflow for probabilistic model selection of reservoir models in unconventional reservoirs.

FIG. 2 illustrates a workflow for a method of probabilistic model selection 200. Different reservoir models representing a range of uncertainties (such as P-10, P-50, and P90 scenarios) are taken to the proposed CNN probabilistic modeling workflow which processes them to generate corresponding CNN predictions with enhanced permeabilities into comma-separated values (csv) file format. The process begins with creating digital slices by cutting 3D models into many 2D slices orthogonal to direction of well trajectory to cover the entire hydraulic fracturing region. The trained CNN algorithm described previously is then used to predict enhanced permeability for the 2D slices. The workflow imports the permeability properties back to a processing and visualization platform for visualizations of enhanced permeability and its post processing for SRV calculations using a grid property calculator. The SRVs for each reservoir model are computed by summing hydrocarbon volume of 3D cells inside region of which the enhanced permeability is greater than cutoff value. The hydrocarbon volume is volume of hydrocarbon (oil and gas) without water inside 3D grid cells. The range of SRVs for each reservoir model is estimated because stimulated region definition varies by changing permeability cutoff. The most representative SRV is decided from probability distribution of SRVs computed from all reservoir models to be used at model selection. All of the steps in the workflow are integrated and automated. The enhanced computational efficiency allows the user to evaluate and discover full range of uncertainties embedded in reservoir models (whole processing time from few minutes to few hours depending on number of cases, compared with weeks if done using conventional methods) by running full factorial design without sacrificing any scenario. The representative SRVs of all reservoir models are sent to next step for data analysis and sensitivity analysis. The relationship between input parameters (e.g., permeability, porosity, Young's modulus, stress, reservoir pressure, water saturation, etc.) and output parameter (SRV in this case) is analyzed and its proxy model is constructed accordingly. Multiple types of proxy models including numerical (Kriging), analytical (Linear, Full quadratic, etc.) and machine learning proxies may be used to construct best-fit response surface model. The number of data sufficient for corresponding proxy model is prepared. At least One-Variable-At-Time (OVAT) design is required as design of experiment to estimate accurate range of each parameter uncertainty range using the numerical proxy model. The sensitivity of input parameters to output parameter is then computed to understand the uncertainties embedded in each geological input parameter and discover potential impact of the parameter to production. The sensitivity results obtained from this invention approach are similar or identical to the typical unconventional probabilistic modeling results in terms of identifying heavy-hitter parameters. The SRV histogram and CDF distribution is constructed from Monte Carlo simulation using the proxy model built from data analysis. The probabilistic P10, P50, and P90 values are defined from the SRV histogram and corresponding P10, P50, P90 probabilistic models are selected accordingly. SRV volume has been used as a key indicator to forecast production recovery from unconventional reservoir applications, because of its high correlations to hydrocarbon production. In this invention, the SRV volume estimated by CNN approach is confirmed to be highly correlated to recovery volume estimated from flow simulation modeling and production forecast, demonstrated in FIG. 15. The selected models from invention approach are very similar to ones from typical probabilistic modeling workflow, with significant time savings and minor differences within acceptable ranges.

The present invention selects probabilistic models using predicted HCIP (Hydrocarbon In Place) inside SRV (Stimulated Rock Volume). All processes from data preparation to SRV calculation are automated and then integrated with an uncertainty analysis tool. This results in a more computationally efficient workflow that can run all possible scenarios or full factorial cases, capture full range of outcomes, and identify any risk associated with subsurface uncertainties.

Figure 3:
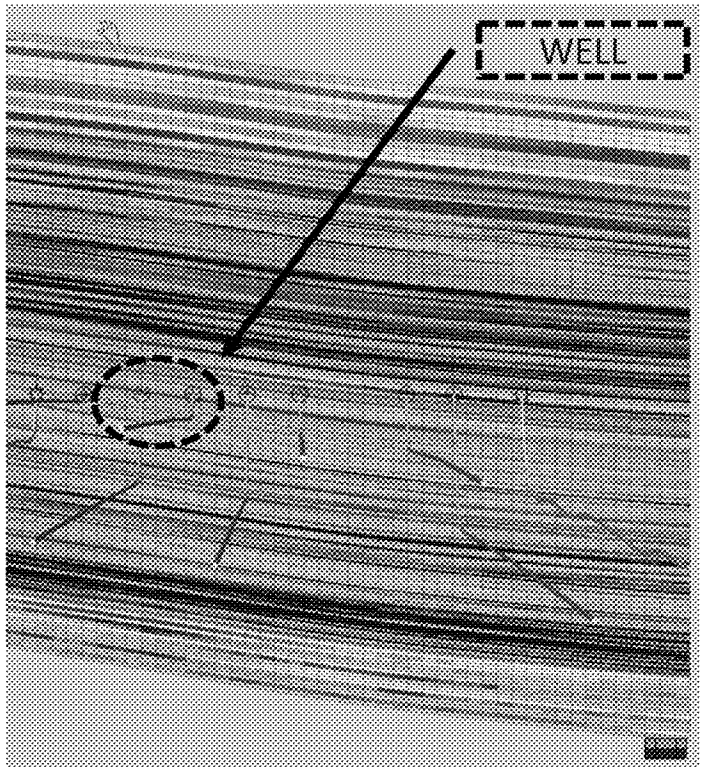
FIG. 3 illustrates an example model to be used in the workflow.
Figure 4:
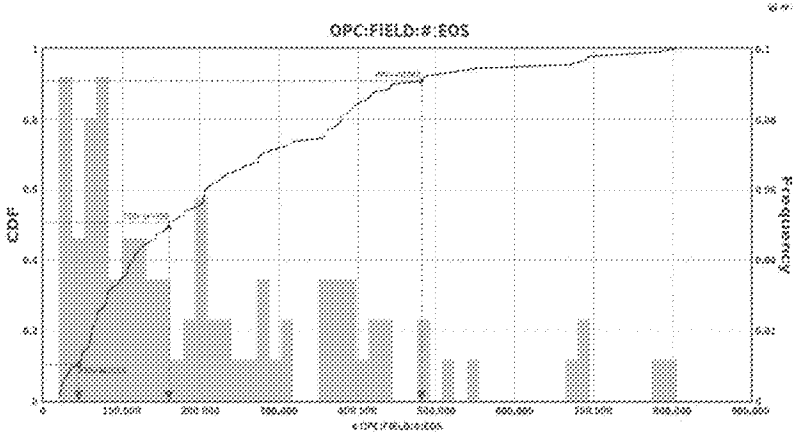
FIG. 4 illustrates a step in an embodiment of the present invention.
Figure 5:
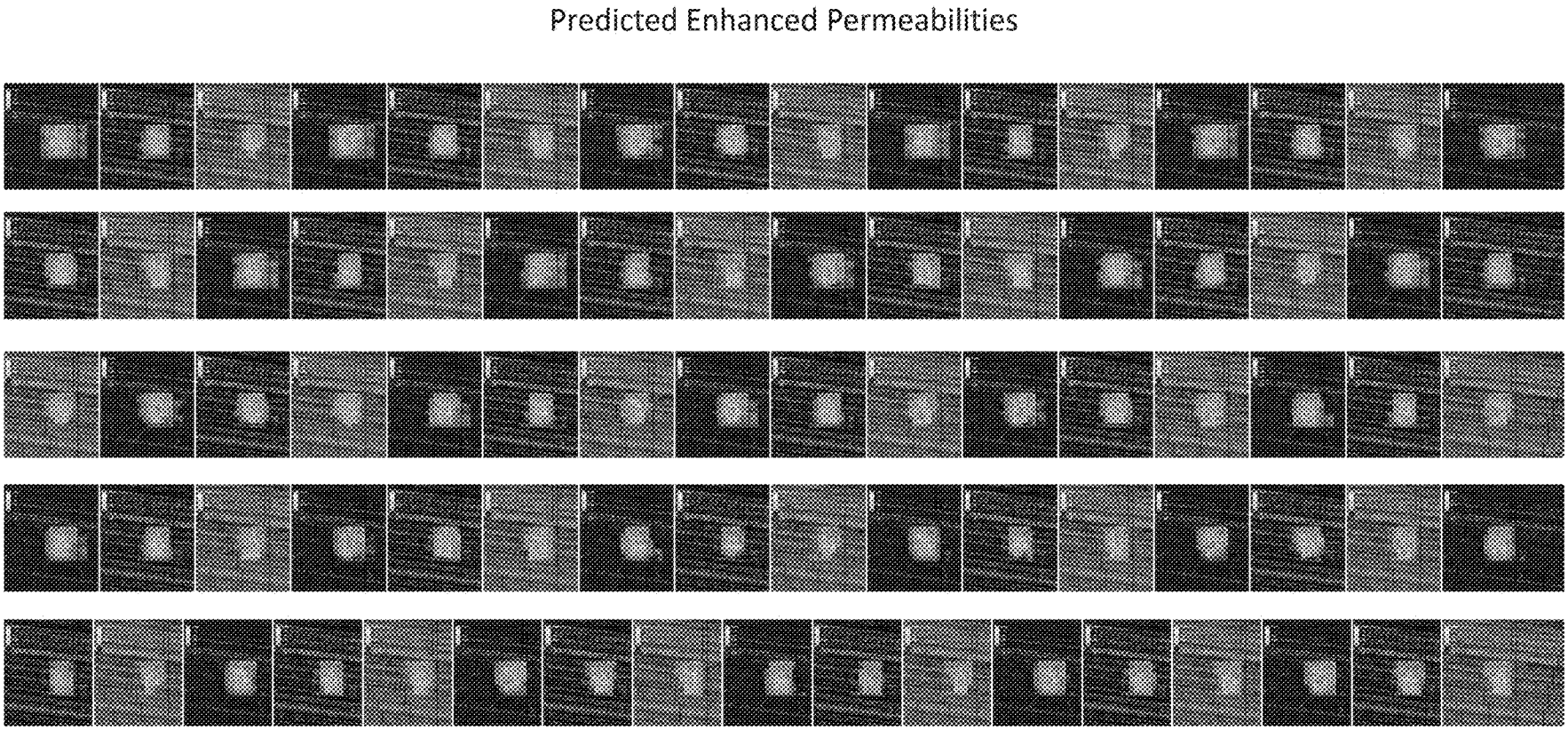
FIG. 5 illustrates a step in an embodiment of the present invention.
Figure 6:
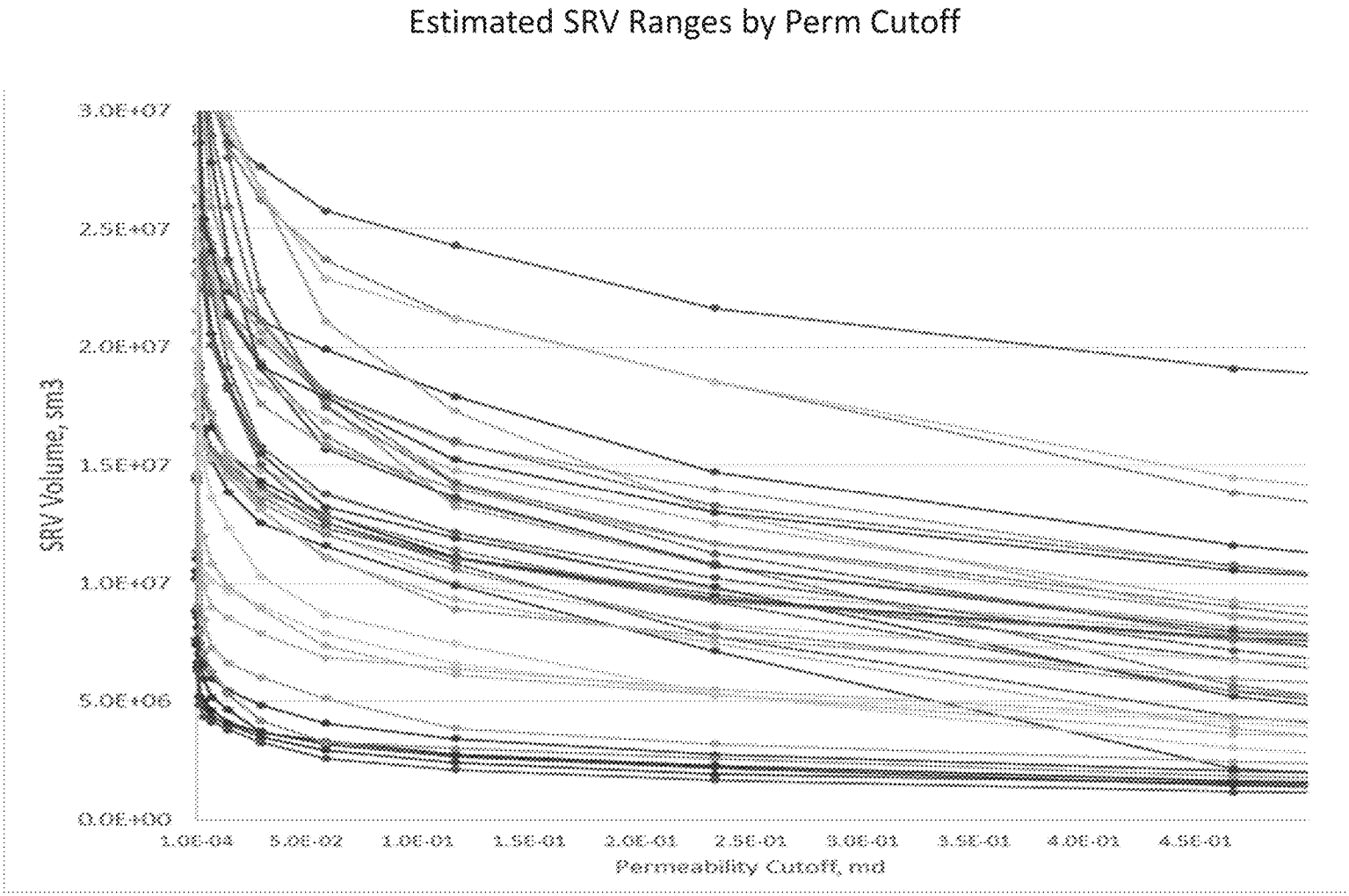
FIG. 6 illustrates a step in an embodiment of the present invention.
Figure 7:
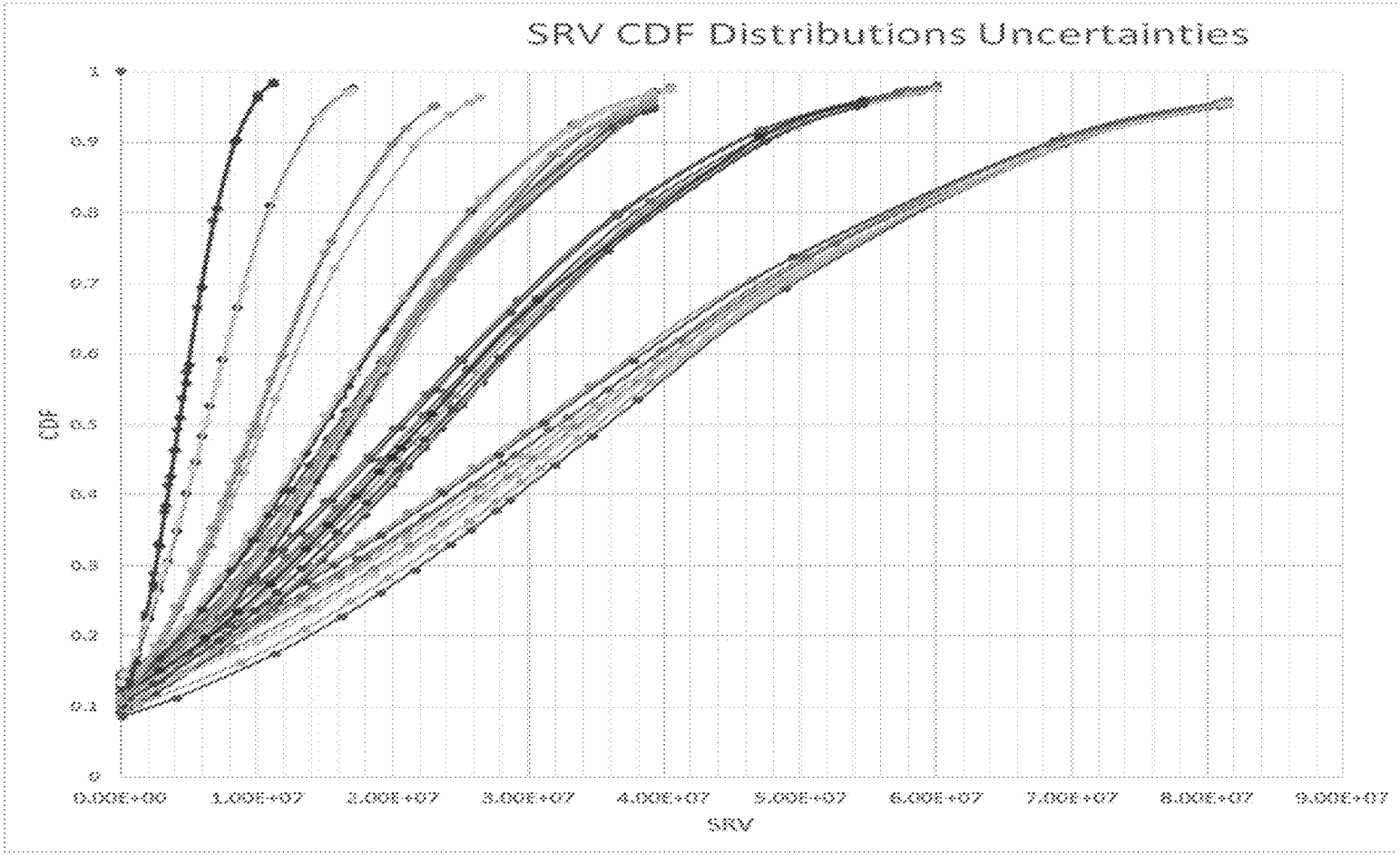
FIG. 7 illustrates a step in an embodiment of the present invention.
Figure 8:
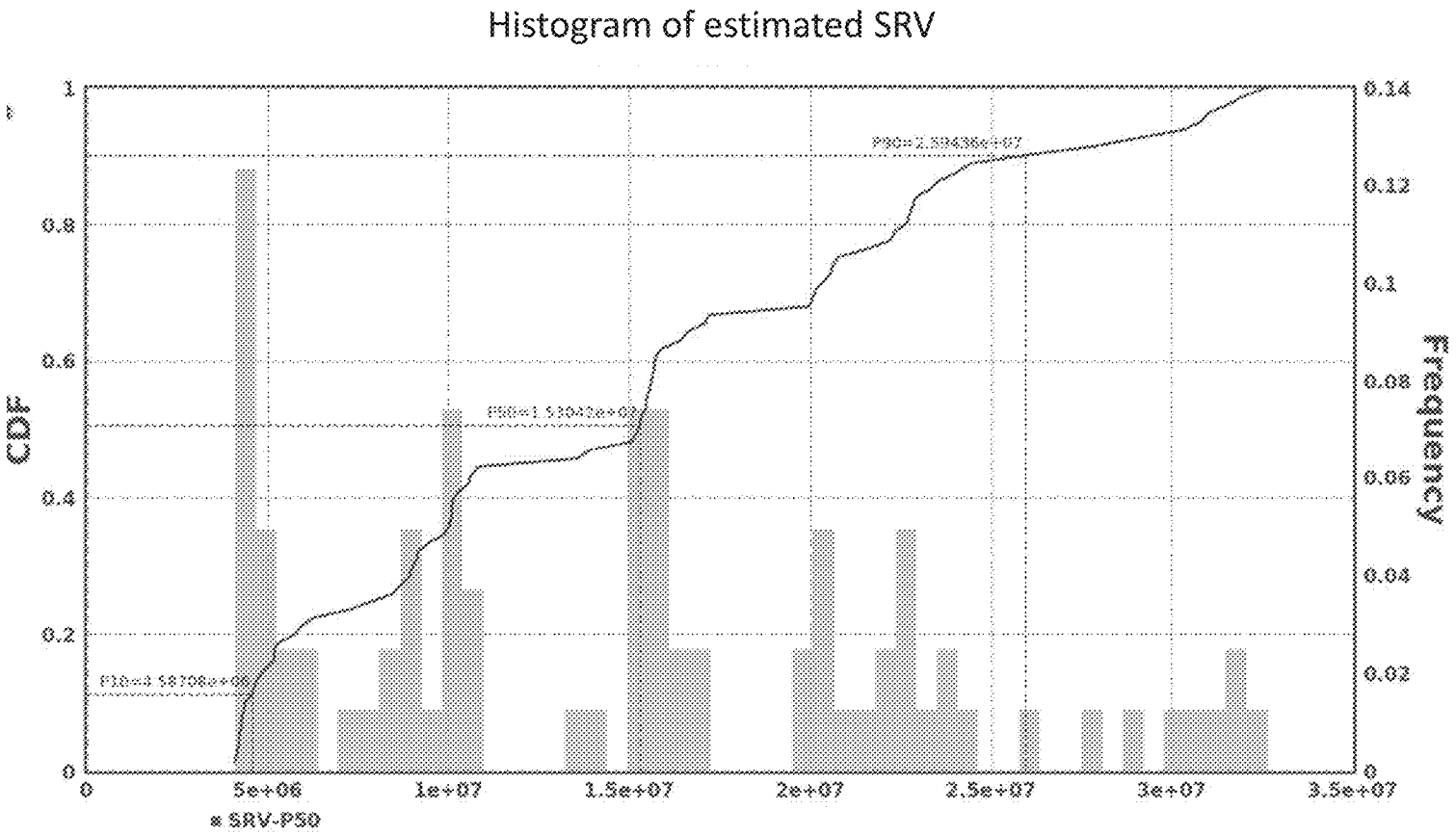
FIG. 8 illustrates a step in an embodiment of the present invention.
Figure 9:
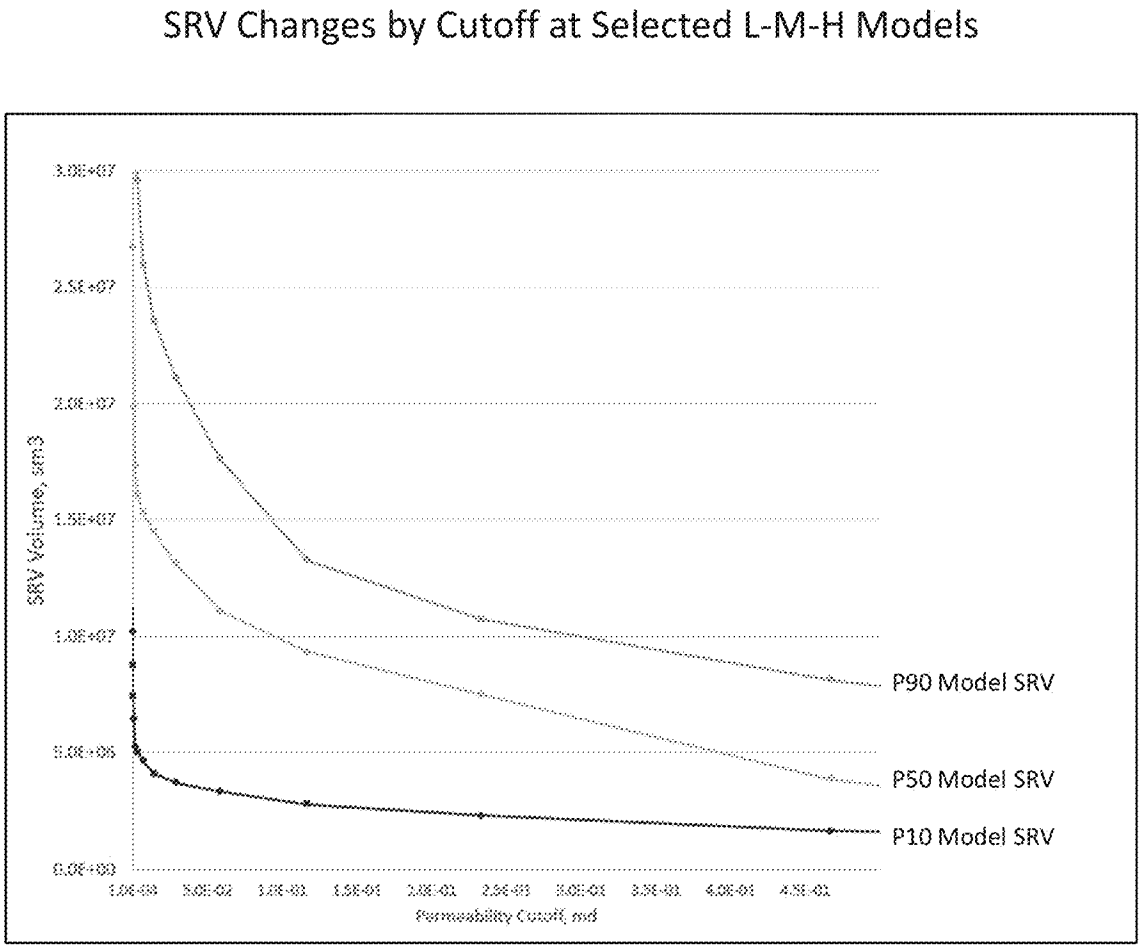
FIG. 9 illustrates a step in an embodiment of the present invention.
Figure 10:
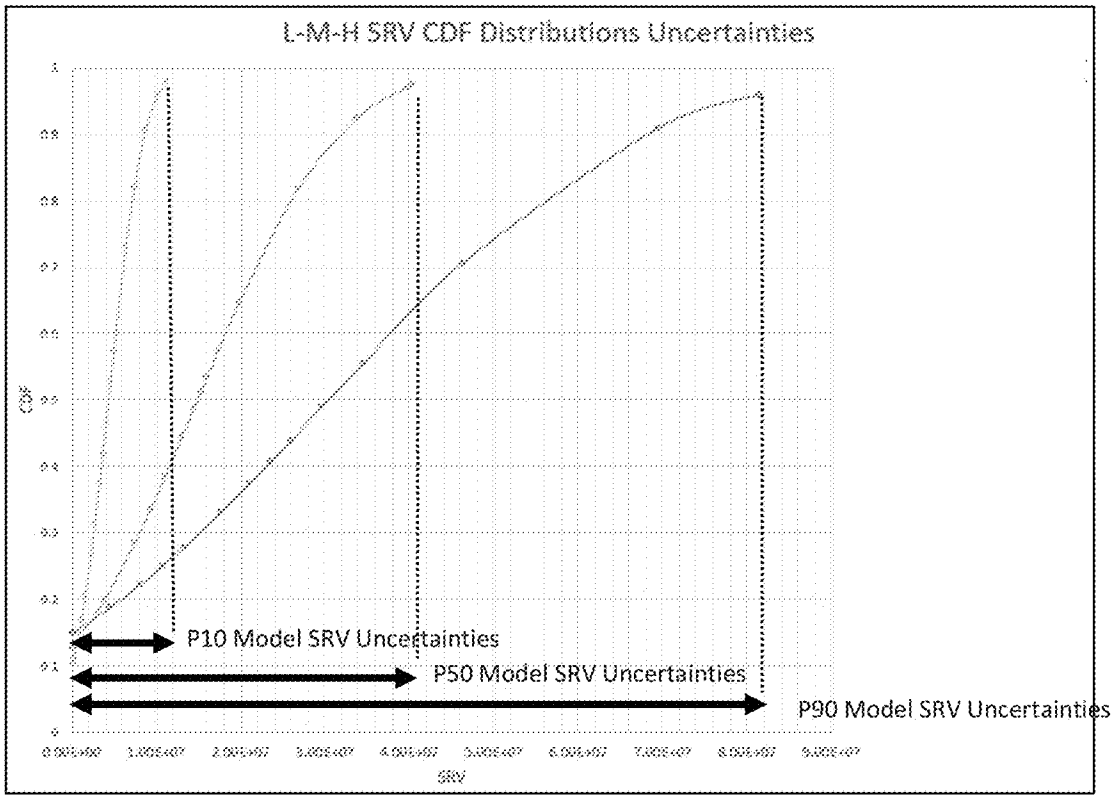
FIG. 10 illustrates a step in an embodiment of the present invention.
Figure 11:
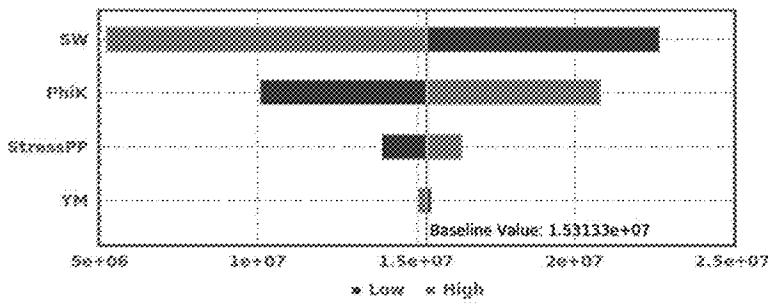
FIG. 11 illustrates a step in an embodiment of the present invention.
Figure 11:
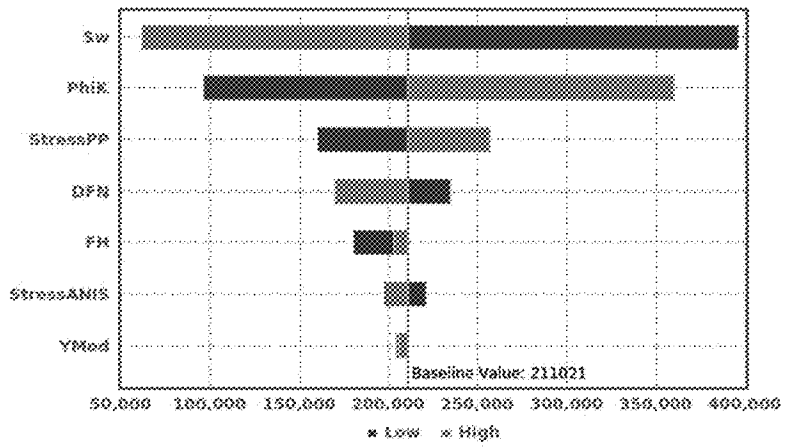
Figure 12:
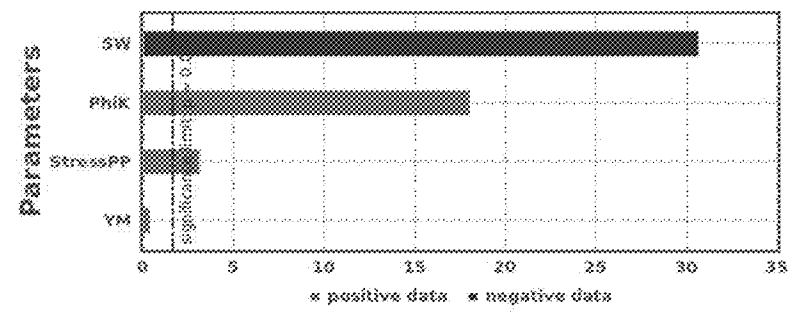
FIG. 12 illustrates a step in an embodiment of the present invention.
Figure 12:
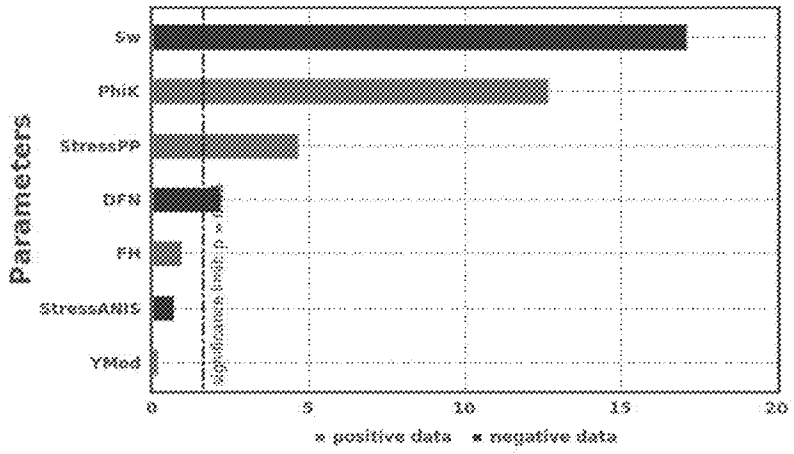
Figure 13:
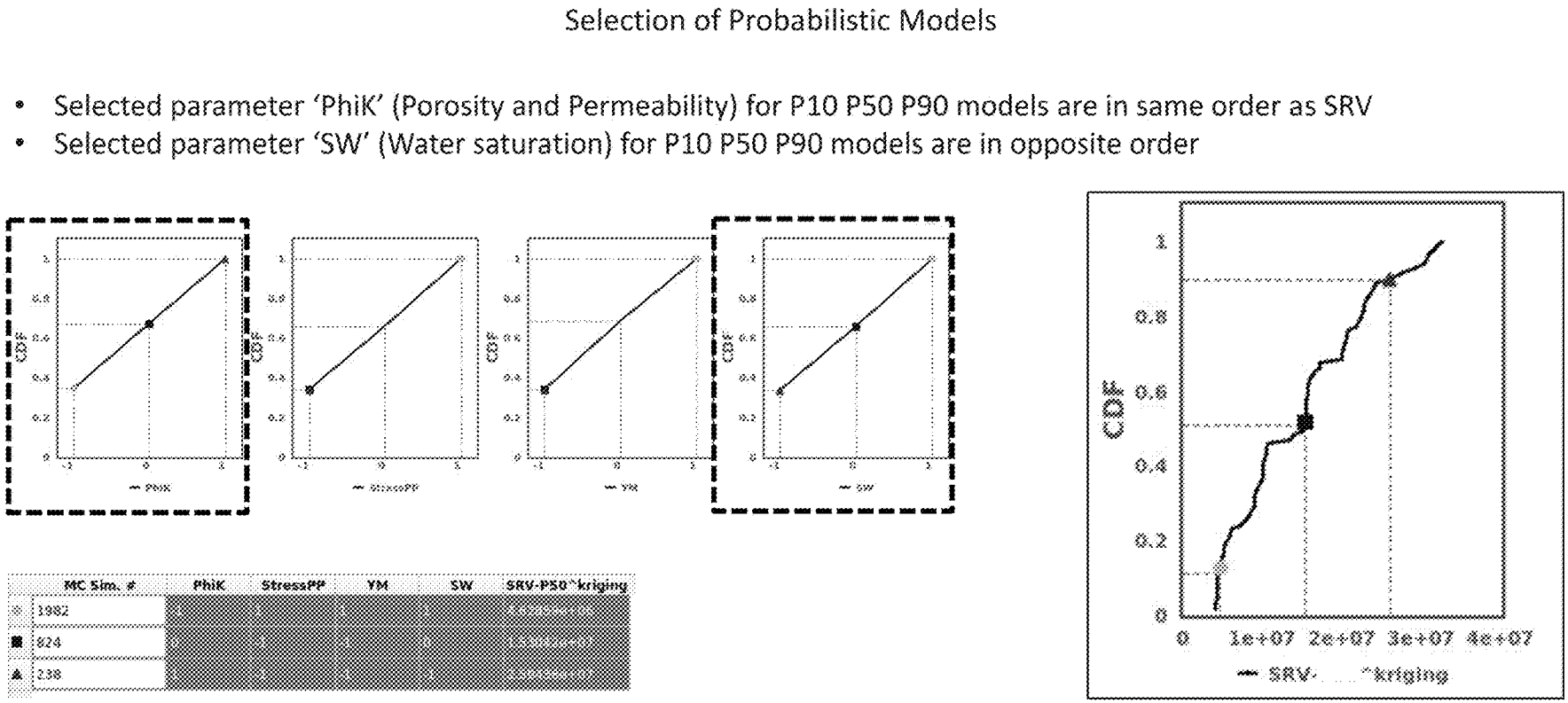
FIG. 13 illustrates a step in an embodiment of the present invention.
Figure 14:
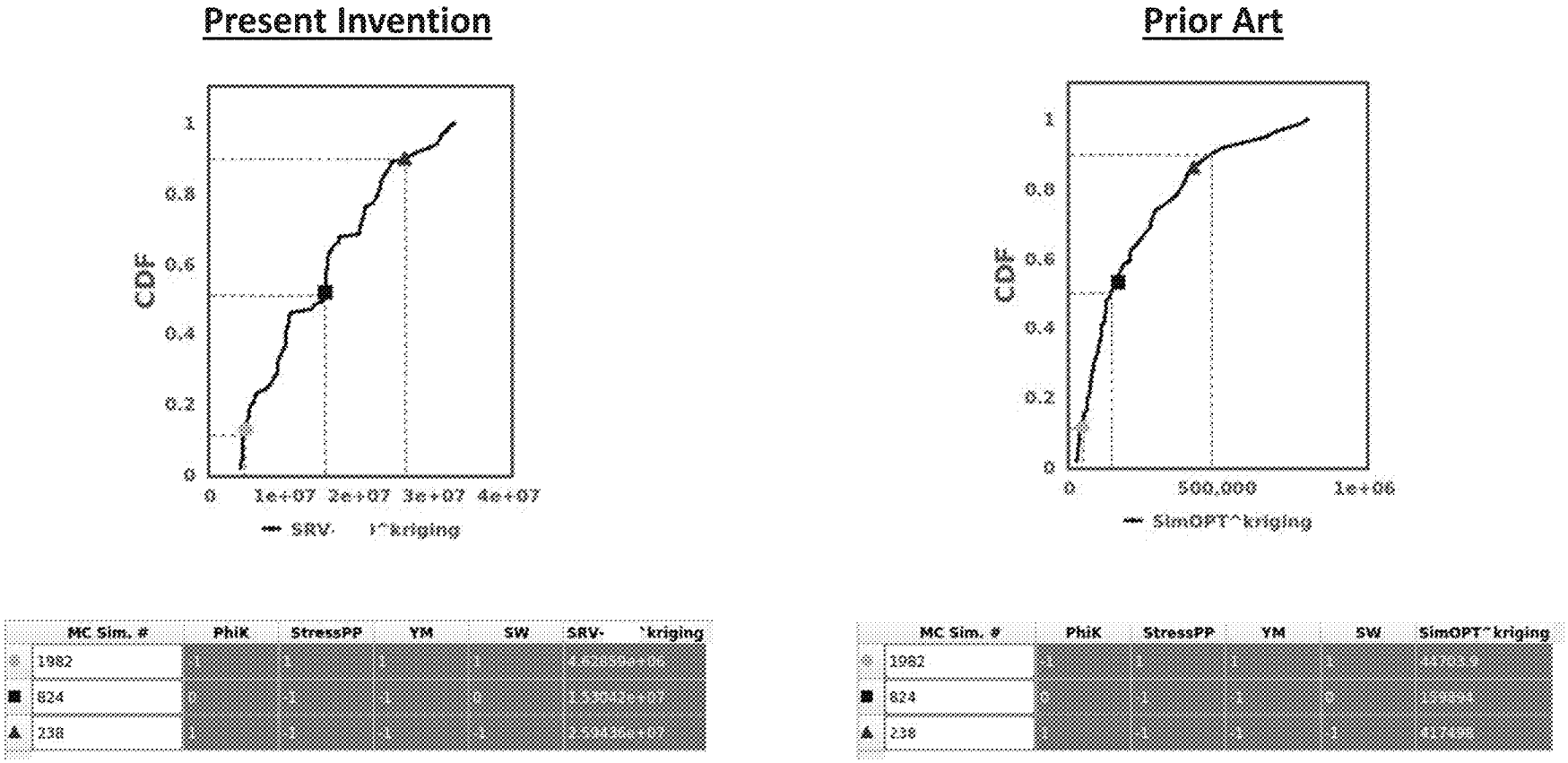
FIG. 14 illustrates a step in an embodiment of the present invention.
Figure 15:
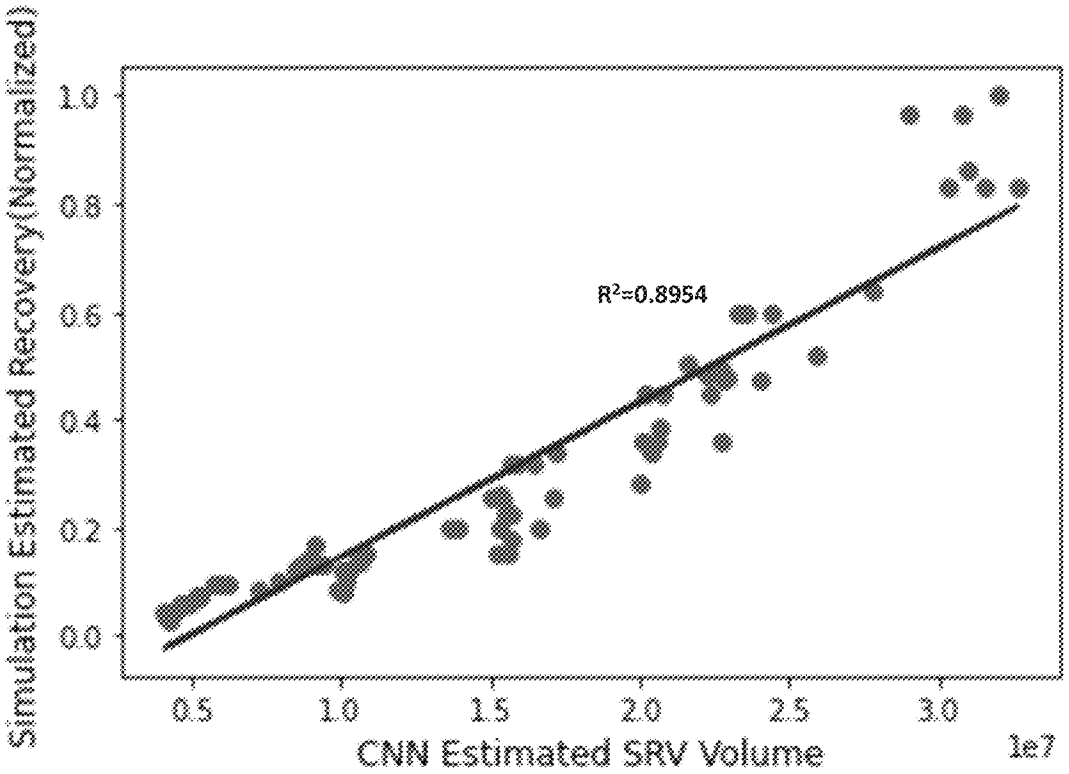
FIG. 15 illustrates a result of an embodiment of the present invention.

Method 200 is demonstrated in FIGS. 3-15. FIG. 3 shows a vertical slice through a reservoir model including well trajectories. FIG. 4 shows models for 3 different probabilities (P-10, P-50, P-90) that are an input for the method. FIG. 5 shows the predicted permeabilities that are generated by the CNN. Predicted permeabilities such as the ones in FIG. 5 are used to calculate the stimulated reservoir volumes, which are analyzed in various ways as shown in FIGS. 6-10. FIG. 6 shows many estimated SRV ranges by permeability cut-off and FIG. 7 shows estimated SRV uncertainties with the cumulative distribution function on the y-axis. FIG. 8 is a histogram of the estimated SRVs with the P-10, P-50, and P-90 models indicated. FIG. 9 shows the estimated SRV ranges by permeability cut-off, as in FIG. 6, but only for the Low-Medium-High models (e.g., P-10, P-50, P-90 models) and FIG. 10 shows the estimated SRV uncertainties with the cumulative distribution function on the y-axis for the Low-Medium-High models. FIG. 11 and FIG. 12 shows the results of the sensitivity analysis, with the sensitivity in FIG. 11 and the significance in FIG. 12, as compared to the results of a conventional method. Note that the present invention uses far fewer parameters than the conventional method, which is another reason it is more computationally efficient. FIG. 13 shows the selection of the representative stimulated reservoir model from among all of the SRVs, FIG. 14 compares it to a model found by a conventional method. FIG. 15 compares the result of method 200 with a simulation of estimated recovery, showing a high correlation.

While particular embodiments are described above, it will be understood it is not intended to limit the invention to these particular embodiments. On the contrary, the invention includes alternatives, modifications and equivalents that are within the spirit and scope of the appended claims. Numerous specific details are set forth in order to provide a thorough understanding of the subject matter presented herein. But it will be apparent to one of ordinary skill in the art that the subject matter may be practiced without these specific details. In other instances, well-known methods, procedures, components, and circuits have not been described in detail so as not to unnecessarily obscure aspects of the embodiments.

The terminology used in the description of the invention herein is for the purpose of describing particular embodiments only and is not intended to be limiting of the invention. As used in the description of the invention and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, operations, elements, and/or components, but do not preclude the presence or addition of one or more other features, operations, elements, components, and/or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined [that a stated condition precedent is true]" or "if [a stated condition precedent is true]" or "when [a stated condition precedent is true]" may be construed to mean "upon determining" or "in response to determining" or "in accordance with a determination" or "upon detecting" or "in response to detecting" that the stated condition precedent is true, depending on the context.

Although some of the various drawings illustrate a number of logical stages in a particular order, stages that are not order dependent may be reordered and other stages may be combined or broken out. While some reordering or other groupings are specifically mentioned, others will be obvious to those of ordinary skill in the art and so do not present an exhaustive list of alternatives. Moreover, it should be recognized that the stages could be implemented in hardware, firmware, software or any combination thereof.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A computer-implemented method of unconventional reservoir modeling including uncertainty estimation, comprising:

a. obtaining a trained physics-guided neural network comprising an encoder-decoder architecture including convolution, pooling, upsampling, and deconvolution operations and configured to ingest multi-channel 2-D or 3-D reservoir property images with physics-based transformations and structural-constraint loss functions;

b. receiving models of reservoir properties representing at least three levels of probabilities and a well trajectory through the models;

c. slicing the models into a plurality of 2-D slices orthogonal to a direction of the well trajectory;

d. providing the 2-D slices as input to the trained physics-guided neural network that processes multi-channel reservoir property images and applies structural-constant loss functions to distinguish fractured zones from non-fractured zones in the reservoir model to generate predicted permeability models;

e. calculating stimulated reservoir volumes based on the predicted permeability models;

f. using the stimulated reservoir volumes to calculate uncertainties and determine a probability distribution of the stimulated reservoir volumes;

g. selecting a representative stimulated reservoir volume from the stimulated reservoir volumes based on the probability distribution of the stimulated reservoir volumes;

h. generating a graphical representation of one or more of the predicted permeability models, the stimulated reservoir volumes, the representative reservoir volume, the uncertainties, and the probability distribution of the stimulated reservoir volumes; and i. displaying the graphical representation on a graphical display.

2. The method of claim 1 wherein the models of reservoir properties include one or more of porosity, permeability, water saturation, Young's Modulus, reservoir pressure, and horizontal stress.

3. The method of claim 1 wherein the three levels of probabilities are P-10, P-50, and P-90.

4. The method of claim 1 wherein the probability distribution of the stimulated reservoir volumes is done by Monte Carlo simulation.

5. A computer system, comprising:

one or more processors;

memory; and one or more programs, wherein the one or more programs are stored in the memory and configured to be executed by the one or more processors, the one or more programs including instructions that when executed by the one or more processors cause the system to:

a. obtain a trained physics-guided neural network comprising an encoder-decoder architecture including convolution, pooling, upsampling, and deconvolution operations and configured to ingest multi-channel 2-D or 3-D reservoir property images with physics-based transformations and structural-constraint loss functions;

b. receive models of reservoir properties representing at least three levels of probabilities and a well trajectory through the models;

c. slice the models into a plurality of 2-D slices orthogonal to a direction of the well trajectory;

d. provide the 2-D slices as input to the trained physics-guided neural network that processes multi-channel reservoir property images and applies structural-constant loss functions to distinguish fractured zones from non-fractured zones in the reservoir model to generate predicted permeability models;

e. calculate stimulated reservoir volumes based on the predicted permeability models;

f. use the stimulated reservoir volumes to calculate uncertainties and determine a probability distribution of the stimulated reservoir volumes;

g. select a representative stimulated reservoir volume from the stimulated reservoir volumes based on the probability distribution of the stimulated reservoir volumes;

h. generate a graphical representation of one or more of the predicted permeability models, the stimulated reservoir volumes, the representative reservoir volume, the uncertainties, and the probability distribution of the stimulated reservoir volumes; and i. display the graphical representation on a graphical display.

6. A non-transitory computer readable storage medium storing one or more programs, the one or more programs comprising instructions, which when executed by an electronic device with one or more processors and memory, cause the device to a. obtain a trained physics-guided neural network comprising an encoder-decoder architecture including convolution, pooling, upsampling, and deconvolution operations and configured to ingest multi-channel 2-D or 3-D reservoir property images with physics-based transformations and structural-constraint loss functions; Dated Nov. 20, 2025 b. receive models of reservoir properties representing at least three levels of probabilities and a well trajectory through the models;

c. slice the models into a plurality of 2-D slices orthogonal to a direction of the well trajectory;

d. provide the 2-D slices as input to the trained physics-guided neural network that processes multi-channel reservoir property images and applies structural-constant loss functions to distinguish fractured zones from non-fractured zones in the reservoir model to generate predicted permeability models;

e. calculate stimulated reservoir volumes based on the predicted permeability models;

f. use the stimulated reservoir volumes to calculate uncertainties and determine a probability distribution of the stimulated reservoir volumes;

g. select a representative stimulated reservoir volume from the stimulated reservoir volumes based on the probability distribution of the stimulated reservoir volumes;

h. generate a graphical representation of one or more of the predicted permeability models, the stimulated reservoir volumes, the representative reservoir volume, the uncertainties, and the probability distribution of the stimulated reservoir volumes; and i. display the graphical representation on a graphical display.

* * * * *